United States Patent [19]

Johnson

[11] Patent Number: 4,766,838

[45] Date of Patent: Aug. 30, 1988

[54] AUXILIARY BOAT SEAT

[76] Inventor: Grady Johnson, Rte. 1, Box 378, Luxora, Ark. 72358

[21] Appl. No.: 67,976

[22] Filed: Jun. 30, 1987

[51] Int. Cl.[4] ..... B63B 29/00

[52] U.S. Cl. ..... 114/363; 297/252; 114/364

[58] Field of Search ..... 114/363, 364; 297/243, 297/250, 251, 252, 253, 345, 349, 350, 452, 315; 248/407, 415, 424, 429; 108/143

[56] References Cited

U.S. PATENT DOCUMENTS

| | | | |
|---|---|---|---|
| 1,126,911 | 2/1915 | Stull | 297/252 |
| 1,736,155 | 11/1929 | Harter | 114/363 |
| 1,894,743 | 1/1933 | Harter | 248/415 |
| 2,299,178 | 10/1942 | Reiter | 114/363 |
| 2,843,348 | 7/1958 | Samuels | 297/252 |
| 2,853,119 | 9/1958 | Balfour | 224/319 |
| 3,113,804 | 12/1963 | Ritter | 297/252 |
| 3,718,365 | 2/1973 | Gibson | 114/363 |
| 3,795,927 | 3/1974 | Darwin, Jr. et al. | 114/363 |
| 3,821,825 | 7/1974 | Bailey | 114/363 |
| 4,357,894 | 11/1982 | Kirk | 114/347 |

*Primary Examiner*—Sherman D. Basinger
*Assistant Examiner*—Edwin L. Swinehart
*Attorney, Agent, or Firm*—Dowell & Dowell

[57] ABSTRACT

An auxiliary seat for small fishing boats which includes a frame that is extendable so as to be adjustable engageable with the gunnels of the boat and from which a seat assembly is supported so as to be selectively horizontally and vertically adjustable relative to the hull of the boat.

8 Claims, 2 Drawing Sheets

AUXILIARY BOAT SEAT

BACKGROUND OF THE INVENTION

1. Field of the Invention

This invention is generally directed to auxiliary or supplemental seats which may be attached to rowboats or small fishing boats and more specifically to an auxiliary seat which is both adaptable to various sizes and styles of the boats as well as being adjustable relative thereto after being installed. The auxiliary boat seat includes outwardly extendable opposite end portions which are engageable over the gunnels of a boat and which are resiliently urged inwardly relative to one another so as to securely clamp the frame in a mounted position on the boat. A slideable mounting bracket is carried by the frame and is horizontally or longitudinally adjustable relative thereto so as to permit a horizontal adjustment of the seat assembly relative to the hull of a boat. In addition, the mounting plate includes a central opening through which a seat supporting spindle is selectively inserted and adjustably maintained so as to permit a vertical adjustment of the seat relative to the mounting frame to thereby allow an individual to selectively adjust the height of the seat relative to the hull of the boat.

2. History of the Related Art

In various environments such as in fresh water lakes, fishermen commonly use flat bottomed or flat hull aluminum boats or rowboats which are normally provided with formed bench type seats fitted between the side walls of the boat. The use of the flat bottomed boats is preferred in many situations as they provide greater stability for the fishermen especially when it is necessary for a fisherman to shift body weight while maneuvering in the boat. Unfortunately, the conventional seats of such rowboats or fishing boats are generally situated below the upper edge or gunnel of the boat and thus require that the fisherman be seated at a very low level with respect to the surface of the water. Such low level seating is disadvantageous for several reasons. First, the angle of incidence of a person's eyesight with respect to the water's surface is necessarily at a lower angle and thereby a person is more susceptible to the influence of light reflection especially in early morning or late evening hours. Such reflections are a nuisance and often make it difficult to observe fishing gear, bobbers or lines which are cast at a distance from the boat. Also, the low conventional seating makes it somewhat difficult for some persons to lift themselves from the seat in order to effectuate movement from one point to another.

In addition to the foregoing, the bench seats of conventional aluminum type fishing boats provide no backrests or back supports. The flat bench seats can become very uncomfortable especially when used over periods of hours. Furthermore, it is very common that conventional bench seats will become wet by water deposited from normal fishing activities thereby presenting additional inconveniences for fishermen or others in the boat.

In an effort to improve the comfort of the seats commonly used with various types of smaller boats, various developments have been made to supplement the conventional seating of such boats. In U.S. Pat. No. 3,795,927 to Darwin, Jr. et al., an adjustable bass bench seat for aluminum boats is disclosed which includes a contoured seat mounted to a supporting frame that has extendable outer clamps which are selectively engageable with the side walls or gunnels of the boat. Although this reference discloses the use of contoured seats which would provide more comfort for fishermen, the benches do not provide for vertical adjustment of the seats so as to allow fishermen to select a preferred seated position which can be varied depending upon both physical considerations and weather considerations which may effect the movement or stability of a boat in the water. Further, once the bench is placed over the boat, it is necessary to screw the end clamps into engagement with the boat thereby requiring a great deal of manual effort to install the unit to the boat.

In U.S. Pat. No. 3,113,804 to Ritter, another contoured and swivelable auxiliary seat is disclosed for boats. Although the structure provides for greater user comfort, it is noted that the unit is designed to be installed directly in an overlying and engaging position with the existing bench seat of a boat. Therefore, vertical adjustment of the unit or seat is not possible. In U.S. Pat. No. 3,821,825 to Bailey, another contoured seat for boats is disclosed which is also removably mounted to the existing bench seat of the boat. Again, no vertical adjustment of the seat is possible and the seat must be positioned in the area of an existing bench type seat.

In U.S. Pat. No. 3,718,365 to Gibson, another type of auxiliary seat attachment for boats is disclosed. In the Gibson patent, a main frame is provided having clamps at the outer ends which are adjustable so as to engage the side walls of the boat. The frame does not provide adjustment relative to the side walls and therefore is limited in its particular application. The seat attachment also provides a contoured seat structure which is carried by a sliding support which is longitudinally movable with respect to the frame. Like the auxiliary seats discussed above, the structure does not provide for vertical adjustment of the seat relative to the boat. Also, the structure relies on frictional engagement of the seat supporting member with the frame in order to maintain the seat in a relativly fixed position with respect to the frame.

In view of the foregoing, although the prior art has made advances in providing greater seating comfort for fishermen and others with respect to fishing boats having flat bottom or rowboat configurations, such structures have not been entirely satisfactory in making available an auxiliary seating apparatus which is more universally adaptable to various sizes and styles of boats and which may be mounted and retained in secure engagement with a boat without utilizing elements which must be manually secured relative to the boat. In addition, the prior art seating devices do not provide the universality of both horizontal and vertical adjustment which would make it possible for fishermen to adapt an auxiliary seat to both a particular position and elevation with respect to the hull of the boat.

Some other examples of auxiliary seats for boats are disclosed in U.S. Pat. Nos. 1,736,155 to Harter, 2,299,178 to Reiter and 4,357,894 to Kirk.

SUMMARY OF THE INVENTION

This invention is directed to an auxiliary boat seat assembly for use with small fishing boats such as flat bottom aluminum type boats. The seat assembly includes a mounting frame having a pair of generally parallel hollow support beams each having a pair of outwardly telescoping supplemental support members longitudinally movable with respect thereto. The inner ends of each of the supplemental support members are connected by spring elements and are continuously urged inwardly of the primary support beams by such spring elements. An outer flange or cleat member is connected between the outermost ends of each of the supplemental support members so as to be selectively engageable beneath the gunnel of a boat and being retained in engagement therewith by the action of the spring elements connected between the supplemental or extendable support members. A slideable bracket having a pair of generally parallel outer tubular sleeves is slideably carried over the support beams of the seat mounting frame and is selectively lockable in adjusted positions with respect thereto. The bracket includes a central opening through which the spindle of a seat is selectively inserted. The spindle includes a plurality of aligned openings which permit the spindle to be selectively vertically adjusted with respect to the bracket to thereby adjust the vertical positioning of the seat with respect to the mounting frame.

It is a primary object of the present invention to provide an auxiliary seat for use with fishing boats and preferably boats having flat bottoms or designated as rowboats wherein a contoured seat may be provided which is both selectively horizontally and vertically adjustable with respect to the hull of the boat to thereby permit a wide range of seating adjustments, placements and alignments to be achieved as desired by a person utilizing the boat.

It is also an object of the present invention to provide an auxiliary seat for fishing boats, especially boats of the flat bottom type, which is selectively mounted to the gunnels of the side walls of the boat and which is automatically secured into engagement with the gunnels by resiliently urged clamping members which are telescopically carried by the seat mounting frame.

It is a further object of the present invention to provide an auxiliary seat for small fishing boats wherein the seat mounting frame includes outwardly telescoping sections which permit the frame to be adjustably secured to various sizes of boats.

It is also an object of the present invention to provide an auxiliary seat which may be utilized by a fisherman and conveniently mounted or dismounted with respect to the gunnels of a small fishing boat without requiring any tools and which permits horizontal adjustment of the auxiliary seat by simple adjustment of a thumb screw and which also enables vertical adjustment of the seat so as to further augment user comfort and convenience.

DESCRIPTION OF THE PREFERRED EMBODIMENT

Figure 1:
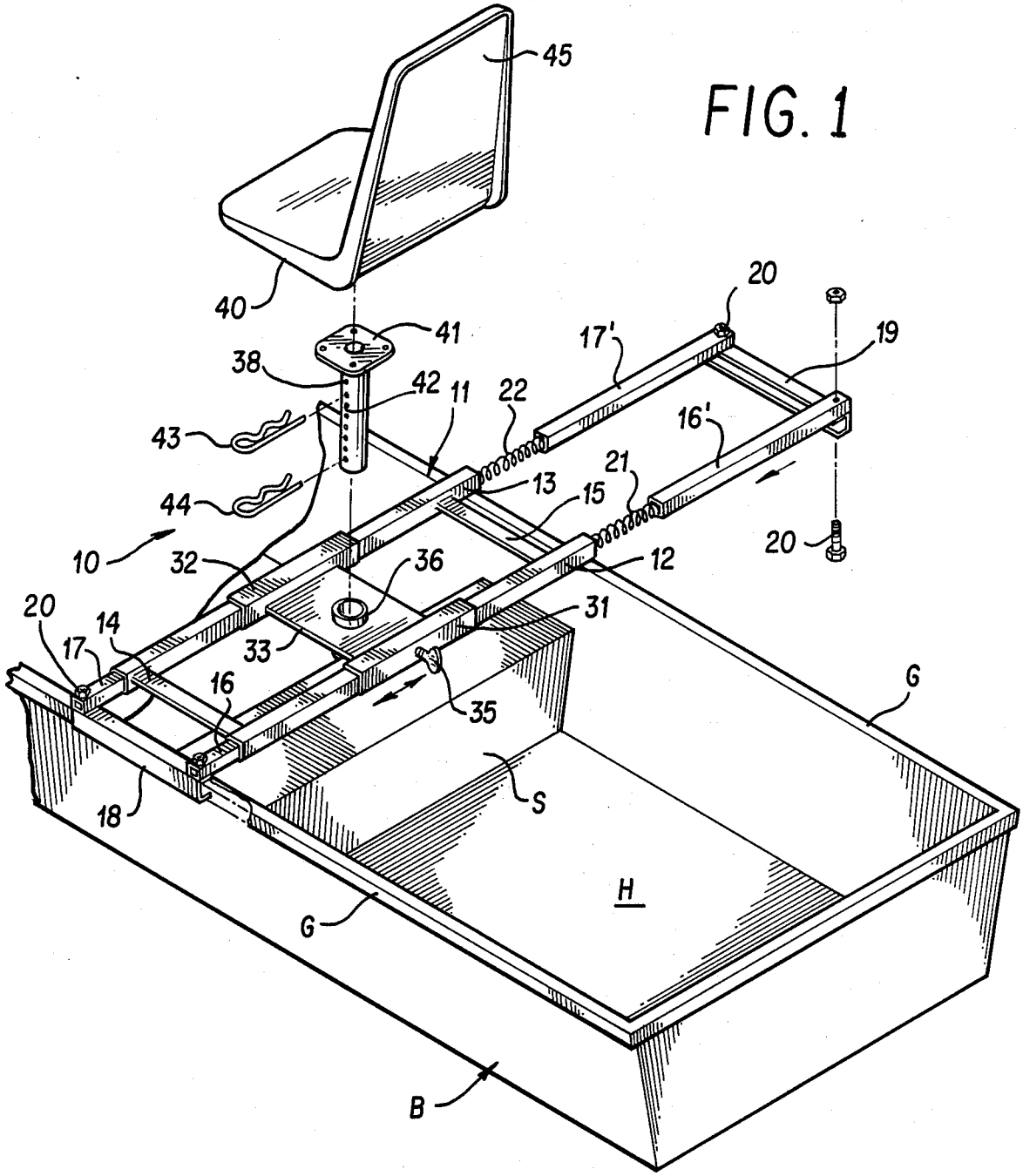
FIG. 1 is a perspective assembly view of the auxiliary boat seat of the present invention shown in relationship to the gunnels of a flat bottom boat.

With continued reference to the drawings, the auxiliary boat seat assembly 10 of the present invention is shown for purposes of illustration as being mounted to the gunnels G of a conventional fishing boat B. The fishing boat is generally of the flat bottom type having a flattened hull H and is provided with a plurality of spaced bench seats S. Conventionally, such flat bottom fishing boats are manufactured of aluminum although other materials may be utilized. Also, the invention may be utilized with hulls having a slightly curved structure such as found in various rowboats of conventional design. The auxiliary boat seat of the present invention is specifically designed to be adaptable to various sizes and types of boats provided that such boats have a gunnel extending around the side wall portions thereof.

The auxiliary seat assembly includes a mounting frame 11 having a pair of generally parallel tubular or hollow beam members 12 and 13 which are of a length which is less than the distance between the opposing gunnels or side walls of conventional fishing boats. Each of the hollow beam members 12 and 13 are shown as being constructed of a square tubing material which is preferably formed of an aluminum or lightweight aluminum-type alloy. The beam members 12 and 13 are integrally joined or reinforced adjacent their ends by a pair of spaced reinforcing flanges 14 and 15 which extend generally perpendicular between the beam members.

Mounted interiorly of each of the beam elements 12 and 13 are opposing pairs of supplemental support beams 16 and 16' and 17 and 17'. Each of the supplemental beam members is of a length which is less than one-half of the length of the beam members 12 and 13 and are of a cross section to be cooperatively received in sliding engagement with the corresponding beam members 12 and 13. In the preferred embodiment, the supplemental beam members may be formed of a tubular stock material having rectangular or square cross sections and which are also formed from an aluminum or aluminum alloy-like material. The supplemental extendable beam members are joined at their outer ends by a pair of spaced clamp elements or cleat members 18 and 19 which are secured to the outer ends of the supplemental beams by means of fasteners 20.

Figure 2:
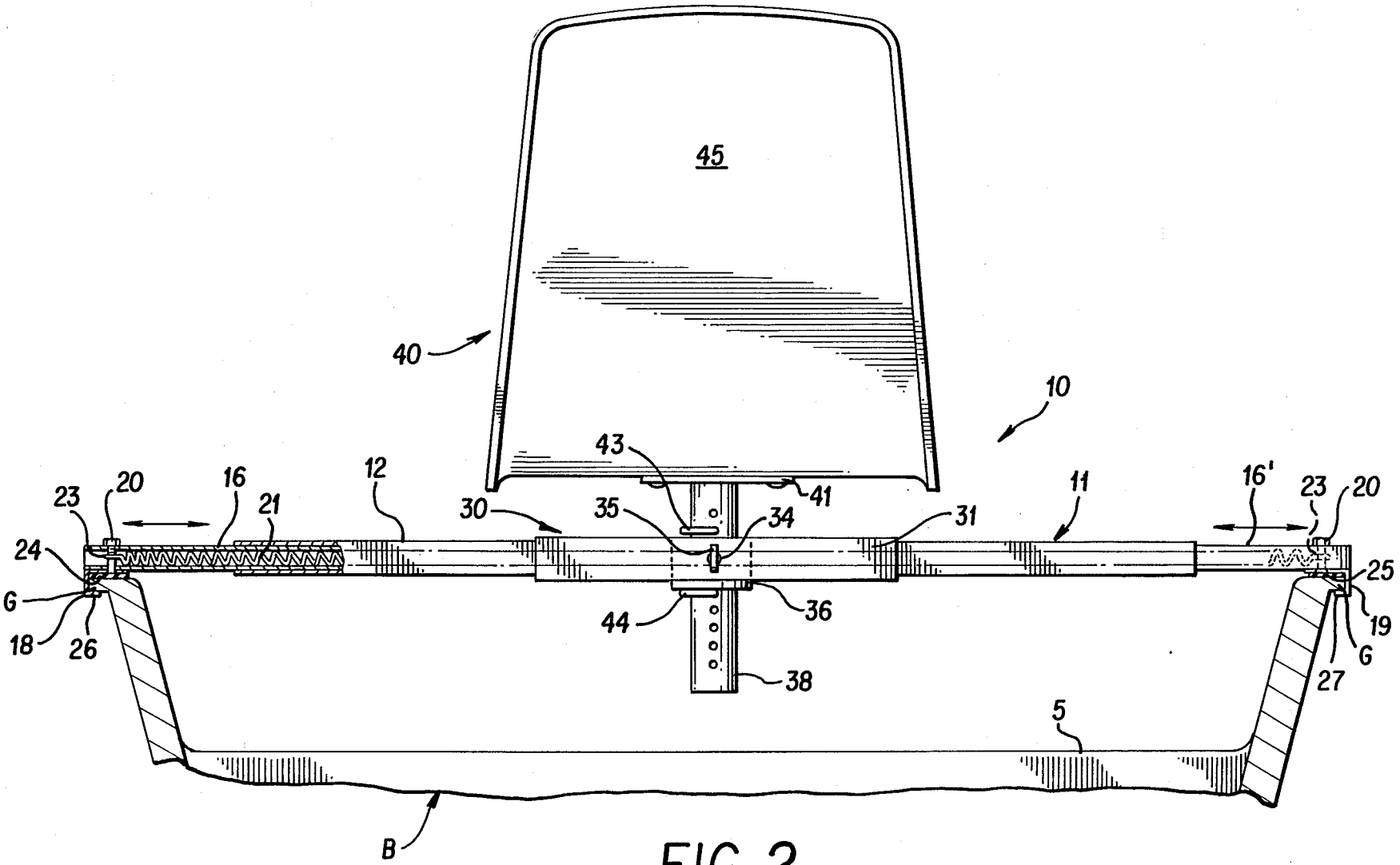
FIG. 2 is an enlarged rear plan view having portions broken away of the auxiliary boat seat of the present invention shown as it is attached to the gunnels of a conventional flat bottom fishing boat.

The supplemental beam members are shown as being resiliently urged inwardly of the primary beam members 12 and 13 by way of elongated springs shown at 21 and 22. With particular reference to FIG. 2, it is noted that the springs are mounted interiorly of the primary beams 12 and 13 and also extend through the hollowed supplemental beams 16, 16', 17 and 17'. The ends 23 of each of the spring elements are shown as being retained by the threaded fasteners 20 and are thereby retained in fixed relationship with respect to the supplemental extendable beams. It is possible that the springs could be made of a shorter dimension and could be fixed at any other location along the length of the supplemental beams such as adjacent the innermost ends thereof as opposed to extending through to adjacent the outermost ends as shown in FIG. 2. It is only necessary that the springs exert a sufficient force on each of the extendable supplemental beam members to continously urge such beam members inwardly toward a seated position within the primary beam members 12 and 13. In this manner, as the extendable beam members are urged outwardly with respect to the primary beam members, the force of the springs will insure that the frame is locked into secure engagement with the boat.

When the supplemental or extendable beam members are in proper position, the clamp elements or cleats 18 and 19 will be securely engaged around the gunnels as shown in FIG. 2. In order to insure that the cleats or clamps are securely seated with the gunnels, rubber buffer strips 24 and 25 may be provided between the outermost ends of the supplemental or extendable beam members and the gunnels of the boat. The buffer material will not only insure a tighter engagement between the flange elements 18 and 19 and the boat gunnels but will also pad the seated engagement of the supplemental beam members with the gunnels. In addition, each of the clamping elements 18 and 19 further includes an inwardly extending flange 26 and 27, respectively, which insure that the clamps or cleats may not be vertically raised relative to the gunnels once the frame is positioned with respect thereto.

The boat seat assembly of the present invention further includes a seat mounting bracket assembly 30 having a pair of generally parallel and spaced sleeve members 31 and 32 which are integrally joined or connected along a portion of their length by an intermediate web material 33. Each of the sleeve members 31 and 32 are formed of a hollow generally rectangular or square tubing material which is of a size to be slidingly received about the beam members 12 and 13. In order to prevent excessive movement of the bracket assembly with respect to the beam members 12 and 13, the dimension of each of the sleeves 31 and 32 should be just slightly greater than that of the beam members 12 and 13 so that only a sliding movement of the sleeves is permitted with respect thereto. An opening 34 is provided through one of the sleeve elements 31 and 32 through which a locking thumb screw 35 may be selectively received. After the mounting bracket has been positioned relative to the mounting frame and beam members 12 and 13, the thumb screw 35 may be manually adjusted to prevent further movement of the bracket assembly with respect to the supporting frame. A generally centrally located bearing sleeve 36 is provided through the web member 33 and serves as a mounting receptacle for the spindle 38 to which the seat 40 is attached.

As shown in the drawings, the seat may be removably secured to an upper flange 41 which is secured to the spindle 38. Although not shown, the seat may include a plurality of roller bearings which enable the seat 40 to be rotated relative to the flange 41.

In order to allow the seat 40 to be elevated with respect to the mounting frame 11, a plurality of aligned openings 42 are provided in spaced relationship along the length of the seat spindle 38. A pair of heavy duty locking pins 43 and 44 are selectively insertable through the spaced pairs of aligned openings both above and below the bearing sleeve 36 to thereby retain the seat spindle in a fixed elevated relationship with respect to the mounting bracket. Vertical adjustment to the seat may thereafter be made by removing the locking pins 43 and 44 and raising or lowering the seat spindle as desired. Although not shown in the drawings, other types of vertical elevating mechanisms may be utilized to facilitate the raising and lowering of the seat with respect to the seat mounting bracket. As shown in the drawings, it is preferred that the seat 40 is provided with a back rest portion 45 for purposes of facilitating the comfort of the individual utilizing the auxiliary seat. Various changes in the contour of the seat 40 may be made as desired.

In the use of the auxiliary boat seat of the present invention, the seat may be stored when not in use by disassembly of the seat spindle 38 from the seat mounting bracket 30. In a non-use position, the seat mounting bracket should be maintained centrally of the beam members 12 and 13 with the auxiliary beam members 16, 16', 17 and 17' being fully received and retracted by action spring elements 21 and 22 within the beam members 12 and 13. When it is desired to mount the auxiliary boat seat to the gunnels of a fishing boat or other flat bottom boat or rowboat, either one of the cleats or clamps 18 and 19 is engaged with one of the gunnels of the boat in the area where the seat is to be installed. With one clamp engaging the gunnel, the other clamp is pulled toward the gunnel of the opposing wall of the boat and brought into overlapping and secured engagement with such gunnel of the opposing wall. The tension of spring elements 21 and 22 will tend to continuously urge the opposing clamps 18 and 19 into intimate contact and secure engagement with the gunnels of the boat. Thereafter, the seat spindle is inserted through the bearing sleeve of the seat mounting bracket until the proper position or elevation of the seat is achieved. The locking pins 43 and 44 are thereafter inserted through aligned pairs of spaced openings in the spindle to thereby secure the seat spindle and the seat in a properly elevated position. Horizontal adjustment of the seat may thereafter be altered by loosening the locking thumb screw 35 and sliding the seat mounting bracket longitudinally of the mounting beam members 12 and 13 until an appropriate position is selected. Thereafter, the locking thumb screw is secured to engage the seat mounting bracket with respect to the mounting frame 11.

As previously discussed, the components of the mounting frame 11 are preferably formed of an aluminum or other non-corrosible material which is lightweight and yet sturdy. The seat mounting bracket is likewise formed of a non-corrosive aluminum or other lightweight material. The seat 40 may be formed of a molded plastic material with the seat spindle 38 and spindle flange 41 being preferably formed of a non-corrosible metallic material.

We claim:

1. An auxiliary boat seat which is selectively mounted to the gunnels of a boat comprising a frame, said frame having a pair of generally parallel primary beam members which are generally oriented inwardly of the gunnels of the boat and at least one pair of generally parallel supplemental beam members slidably carried by said primary beam members so as to be extendable outwardly with respect thereto, a pair of spaced and generally opposing clamp means carried by said frame for selectively engaging the gunnels of the boat, at least one of said clamp means being carried by said supplemental beam members of said frame so as to be selectively movable outwardly with respect to said primary beam members of said frame, resilient means for normally urging said supplemental beam members toward said primary beam members, bracket means slideably carried by said frame, said bracket means having bearing means disposed therein, a seat means, said seat means including a vertically extending spindle, said spindle being of a size to be cooperatively received within said bearing means of said bracket means, and means for selectively retaining said spindle means in vertically adjusted positions with respect to said bracket means.

2. The auxiliary boat seat of claim 1 in which said frame includes a first and second pair of outwardly and oppositely oriented supplemental beam members which are slideably carried by said primary beam members, and resilient means for urging each of said first and second pairs of supplemental beam members inwardly with respect to one another and said primary beam members of said frame.

3. An auxiliary boat seat which is selectively mounted to the gunnels of a boat comprising a frame, said frame including a pair of generally parallel and spaced hollow beam members having first and second ends which are generally oriented inwardly of the gunnels of the boat, a pair of opposing telescoping members slideably carried within each of said first and second ends of each of said beam members, means for resiliently urging each of said telescoping members inwardly with respect to said beam members, each of said telescoping members having an outermost end portion, clamp means mounted adjacent said outermost end portions of said telescoping members, bracket means slideably carried by said frame, means for securing said bracket means relative to said frame, said bracket means having bearing means disposed therein, a seat means, said seat means including a vertically extending spindle, said spindle being of a size to be cooperatively received within said bearing means of said bracket means, and means for vertically adjusting said spindle means with respect to said bracket means.

4. The auxiliary boat seat of claim 3 in which said bracket means includes first and second spaced generally parallel hollow sleeve members, said sleeve members being cooperatively seated in sliding engagement about said pair of beam members, a web portion connecting said first and second sleeve members, said bearing means being formed within said web member between said sleeve members.

5. The auxiliary boat seat of claim 4 in which said means for vertically adjusting said spindle means includes a plurality of pairs of vertically spaced openings and locking pin means selectively insertable through said openings in said spindle means.

6. The auxiliary boat seat of claim 4 in which said resilient means includes first and second elongated spring members having opposite end portions, means for securing said opposite end portions of said spring members to each of said oppositely oriented telescoping members.

7. The auxiliary boat seat of claim 4 including pad means mounted adjacent each of said outermost end portions of said telescoping members adjacent said clamping members.

8. An auxiliary boat seat which is selectively mounted to the gunnels of a boat comprising a frame, said frame having a pair of generally parallel hollow beam members which extend inwardly between the gunnels of the boat, a pair of oppositely oriented and extendable supplemental beam members carried by each of said beam members, resilient means mounted within each of said beam members for resiliently urging said supplemental beam members inwardly thereof, clamp means carried by said supplemental beam members for engaging the gunnels of the boat, a bracket assembly slideably carried by said beam members so as to be longitudinally adjustable with respect thereto, a seat means mounted to said bracket means, and means for selectively vertically adjusting said seat means with respect to said bracket means.

* * * * *